US010002579B2

(12) United States Patent
Tsunashima

(10) Patent No.: US 10,002,579 B2
(45) Date of Patent: Jun. 19, 2018

(54) DISPLAY DEVICE

(71) Applicant: Japan Display Inc., Minato-ku (JP)

(72) Inventor: Takanori Tsunashima, Tokyo (JP)

(73) Assignee: Japan Display Inc., Minato-ku (JP)

( * ) Notice: Subject to any disclaimer, the term of this patent is extended or adjusted under 35 U.S.C. 154(b) by 137 days.

(21) Appl. No.: 15/155,218

(22) Filed: May 16, 2016

(65) Prior Publication Data

US 2017/0004786 A1 Jan. 5, 2017

(30) Foreign Application Priority Data

Jun. 30, 2015 (JP) ..... 2015-130847

(51) Int. Cl.
*G09G 3/36* (2006.01)

(52) U.S. Cl.
CPC ... *G09G 3/3648* (2013.01); *G09G 2300/0426* (2013.01); *G09G 2300/0857* (2013.01); *G09G 2310/0281* (2013.01); *G09G 2330/021* (2013.01)

(58) Field of Classification Search
None
See application file for complete search history.

(56) References Cited

U.S. PATENT DOCUMENTS

2008/0238867 A1* 10/2008 Maeda ..... G09G 3/344 345/107
2012/0154736 A1 6/2012 Nagasawa et al.
2012/0162594 A1 6/2012 Tamaki et al.
2014/0015866 A1* 1/2014 Teranishi ..... G09G 3/2007 345/690
2014/0209882 A1* 7/2014 Tomida ..... G09G 3/3233 257/40
2016/0077394 A1 3/2016 Nagasawa et al.

FOREIGN PATENT DOCUMENTS

JP 2012-145925 8/2012

* cited by examiner

*Primary Examiner* — Jennifer Mehmood
*Assistant Examiner* — Krishna Neupane
(74) *Attorney, Agent, or Firm* — Oblon, McClelland, Maier & Neustadt, L.L.P.

(57) ABSTRACT

According to one embodiment, a first Pixel is connected to a first source line via a first switch included in a first Pixel and the second Pixel is connected to a second source line via a second switch included in the second Pixel. The first Pixel has a first memory, and the second Pixel has a second memory. A first potential line supplies data 1 and a second potential line supplies data 0. The first and second Pixels can store data 1 or 0, when a gate signal is applied to a gate line and the first and second switches are turned on. In this case, in order to store the same data (1 or 0) in the first and second memories, the first and second source lines should be applied different revel signals each other.

7 Claims, 8 Drawing Sheets

DISPLAY DEVICE

CROSS-REFERENCE TO RELATED APPLICATIONS

This application is based upon and claims the benefit of priority from Japanese Patent Application No. 2015-130847, filed Jun. 30, 2015, the entire contents of which are incorporated herein by reference.

FIELD

Embodiments described herein relate generally to a display device.

BACKGROUND

In a liquid crystal display device, pixels are arrayed in a row direction (X-direction) and a column direction (Y-direction). The row direction (X-direction) crosses the column direction (Y-direction). For example, gate lines parallel to the X-direction are arranged at certain intervals in the Y-direction. Further, source lines parallel to the Y-direction are arranged at certain intervals in the X-direction. The pixels are located near intersections of the gate lines and the source lines, respectively.

It should be noted that each pixel comprises a digital memory in some liquid crystal display devices. In a liquid crystal display device in which each pixel comprises a digital memory, there is no need to supply a voltage to all the source lines frequently (i.e., rewrite a pixel signal frequently), for example, in the case of displaying a still image in the entire display area of the device for a long time. In this case, power consumption of the display device can be reduced. There is no need to supply a voltage to all the source lines frequently also in the case of displaying a still image in a part of the display area and displaying moving images in the rest of the display area. In this case, too, the power consumption of the display device can be reduced because the voltage (pixel signal for moving images) should be supplied only to source lines of the rest of the display area.

In the above liquid crystal display device, however, contents of digital memories are often rewritten at the same time in each row. In such a case, for example, all the memories in the same row may be rewritten from high level to low level or from low level to high level at the same time. This level change depends on the content of a write digital video signal.

In such operation, if a number of source lines to which the write digital video signal is output have the same polarity at the same time, a significant voltage drop occurs in an output circuit that outputs the digital video signal. This may result in a data error.

BRIEF DESCRIPTION OF THE DRAWINGS

FIG. 2 is applied to a color display device.

DETAILED DESCRIPTION

Various embodiments will be described hereinafter with reference to the accompany drawings.

In general, according to one embodiment, a display device capable of stabilizing operation of a digital memory in each pixel and a method of driving the display device are provided.

According to an embodiment of the present disclosure, a display device comprising:

parallel gate lines;

parallel source lines crossing the gate lines;

a first potential line and a second potential line parallel to each of the gate lines for outputting data; and pixels arranged near intersections of the gate lines and the source lines, respectively, wherein each of the pixels comprises:

a first switch, a corresponding source line being connected to an input electrode of the first switch, the first switch being turned on when a corresponding gate line is at one potential and turned off when the gate line is at other potential;

a second switch, an input electrode of the second switch being connected to an output electrode of the first switch in series, the second switch being turned off when the corresponding gate line is at the one potential and turned on when the gate line is at the other potential; and a memory circuit which stores any one of first logical data of the first potential line and second logical data of the second potential line when the first switch is turned on and any one of a high level input signal and a low level input signal is input from the corresponding source line, and a logical data input terminal of a first memory circuit of a first pixel is connected to the first potential line and a logical data input terminal of a second memory circuit of a second pixel adjacent to the first pixel is connected to the second potential line, and the first and second memory circuits have same logic data when input signals of different levels are supplied to source lines corresponding to the first and second pixels while a first switch of each of the first and second pixels is in an on-state.

The embodiment will further be described with reference to the drawings.

Figure 1:
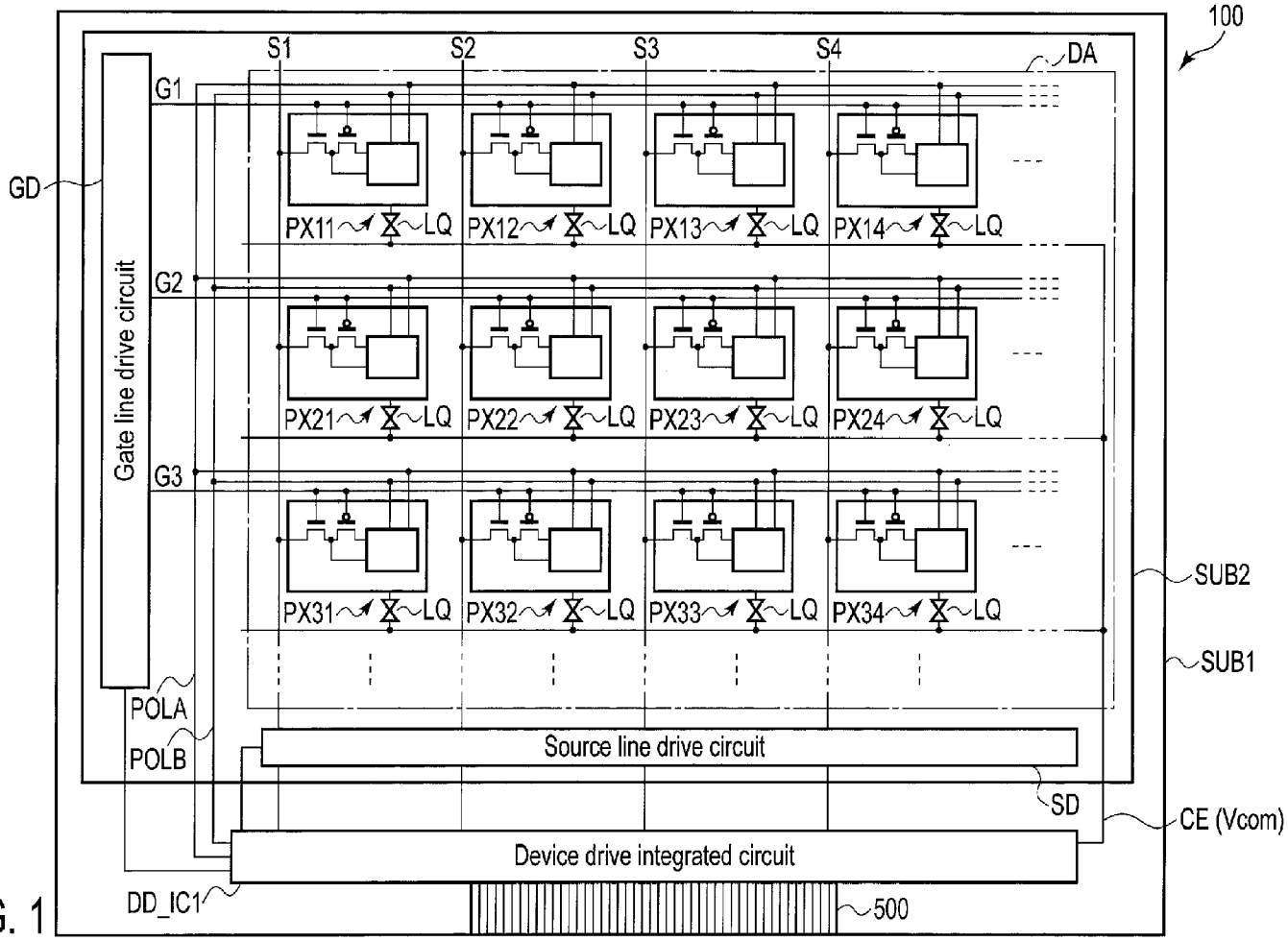
FIG. 1 is a diagram schematically showing a configuration example of a display device which is an embodiment.

FIG. 1 schematically shows a configuration of a display device 100 of the present embodiment. The display device 100 comprises an array substrate (also called a first substrate) SUB1, a counter-substrate (also called a second substrate) SUB2 and a display area DA constituted by a matrix of pixels PX (PX11, PX12, . . . , PX21, PX22, . . . , PX31, PX32, . . . ). FIG. 1 shows pixels PX11 to PX 34 of a number of pixels. The array substrate SUB1 and the counter-substrate SUB2 are a pair of transparent insulating substrates opposed to each other. A liquid crystal layer LQ is held between the array substrate SUB1 and the counter-substrate SUB2.

In the display area DA, the first substrate SUB1 comprises gate lines G (G1 to Gn) extending in a first direction X and source lines S (S1 to Sm) extending in a second direction Y crossing the first direction X. FIG. 1 shows gate lines G1, G2 and G3 and source lines S1, S2, S3 and S4.

Figure 2:
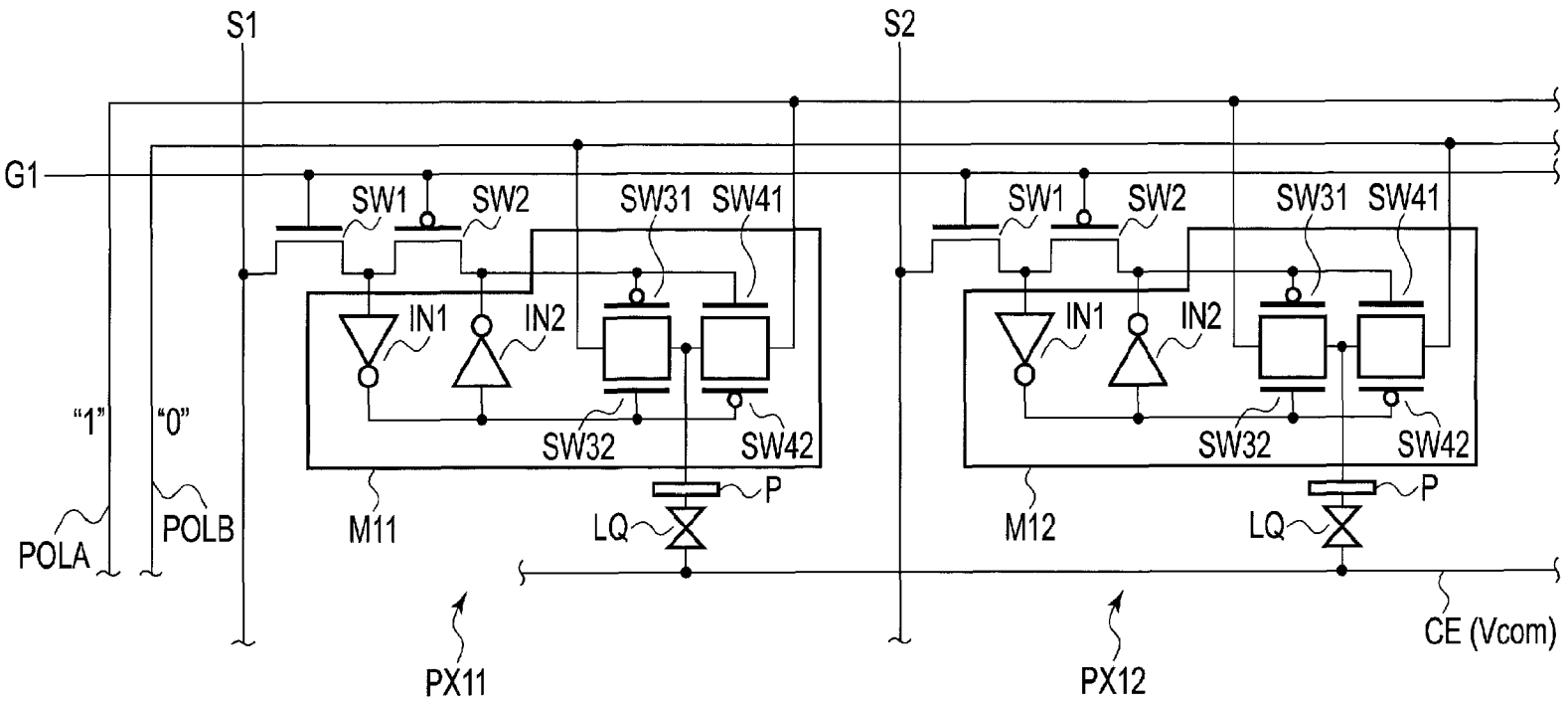
FIG. 2 is a diagram showing configurations of pixels PX11 and PX12 shown in FIG. 1 as a representative.

Each pixel PX (PX11 to PX34) is configured as shown in FIG. 2, which will be described later.

Each gate line G (G1 to Gn) is led out to the outside of the display area DA and connected to a first drive circuit (it may be called a gate line drive circuit) GD. Each source line S (S1 to Sm) is led out to the outside of the display area DA and connected to a second drive circuit (it may be called a source line drive circuit) SD. For example, at least a part of the first drive circuit GD and the second drive circuit SD is formed on the first substrate SUB1 and connected to a device drive integrated circuit (also called a liquid crystal driver) DD_IC.

The device drive integrated circuit (device drive IC) DD_IC is connected to one terminal of a flexible printed circuit via a connection terminal 500. The other terminal of the flexible printed circuit is connected to a host device (not shown). The host device (also called a controller) can intercommunicate with the device drive IC DD_IC and output image data, synchronizing pulse, etc.

A configuration example of each pixel PX is described with reference to FIG. 2. FIG. 2 shows pixels PX11 and PX12 as a representative. First, the configuration of the pixel PX11 is described. Switches SW1 and SW2 are formed of, for example, thin-film transistors (TFT), and connected in series. The switch SW1 is a P-channel transistor and the switch SW2 is an N-channel transistor. Gate electrodes of the switches SW1 and SW2 are connected to the gate line G1. A source electrode (input electrode) of the switch SW1 is connected to the source line S1. A drain electrode (output electrode) of the switch SW1 is connected to a source electrode (input electrode) of the switch SW2 and an input electrode of an inverter IN1 constituting a memory circuit M11. A drain electrode (output electrode) of the switch SW2 is connected to gate electrodes of switches SW31 and SW41.

An output electrode of the inverter IN1 is connected to an input electrode of an inverter IN2 and gate electrodes of switches SW32 and switch SW42. An output electrode of the inverter IN2 is connected to the drain electrode (output electrode) of the switch SW2. The switch SW31 uses negative logic and the switch SW32 uses positive logic. In contrast, the switch SW42 uses negative logic and the switch SW41 uses positive logic.

For example, an input side electrode (also called a logical data input unit) connected in common to the switch SW31 and the switch SW32 is connected to a second potential line POLB serving as a power source line (also called data 0) and an output side electrode connected in common is connected to the pixel electrode P. For example, an input side electrode (also called a logical data input unit) connected in common to the switch SW41 and the switch SW42 is connected to a first potential line POLA serving as a power source line (also called data 1) and an output side electrode connected in common is connected to the pixel electrode P. The liquid crystal layer LQ is present between the pixel electrode P and the common electrode CE. For example, the pixel electrode P is formed on the first substrate SUB1 so as to correspond to a position of the pixel and the common electrode CE is formed on the second substrate SUB2.

A configuration of the pixel PX12 adjacent to the pixel PX11 is basically the same as the pixel PX11. However, a connection form of a memory circuit M12 of the pixel PX12 to the second potential line POLB and the first potential line POLA is different from a connection form of the memory circuit M11 of the pixel PX11 to the second potential line POLB and the first potential line POLA. That is, the input side electrode (logical data input unit) of the switches SW31 and SW32 of the memory circuit M11 of the pixel PX11 is connected to the second potential line POLB and the input side electrode (logical data input unit) of the switches SW41 and SW42 is connected to the first potential line POLA, but an input side electrode (logical data input unit) of switches SW31 and SW32 of the memory circuit M12 of the pixel PX12 is connected to the first potential line POLA and an input side electrode (logical data input unit) of switches SW41 and SW42 is connected to the second potential line POLB.

Figure 3:
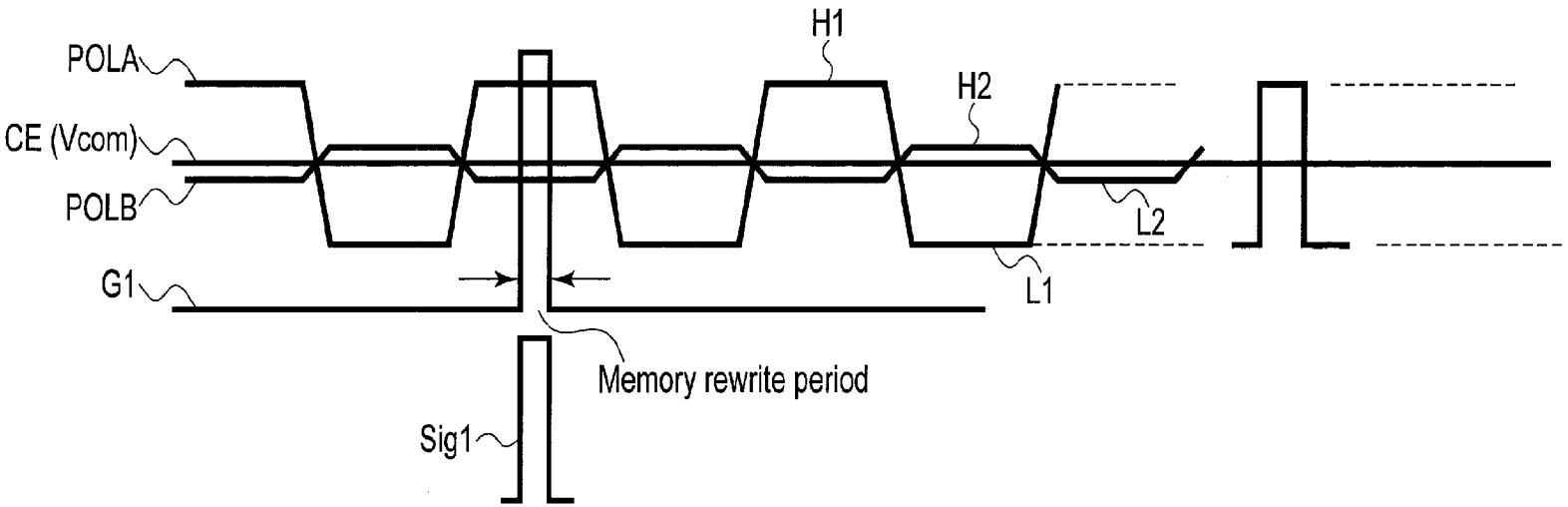
FIG. 3 is a waveform chart showing an example of voltage changes of each component and a signal to explain an operation example of the pixels PX11 and PX12 shown in FIG. 2.
Figure 4:
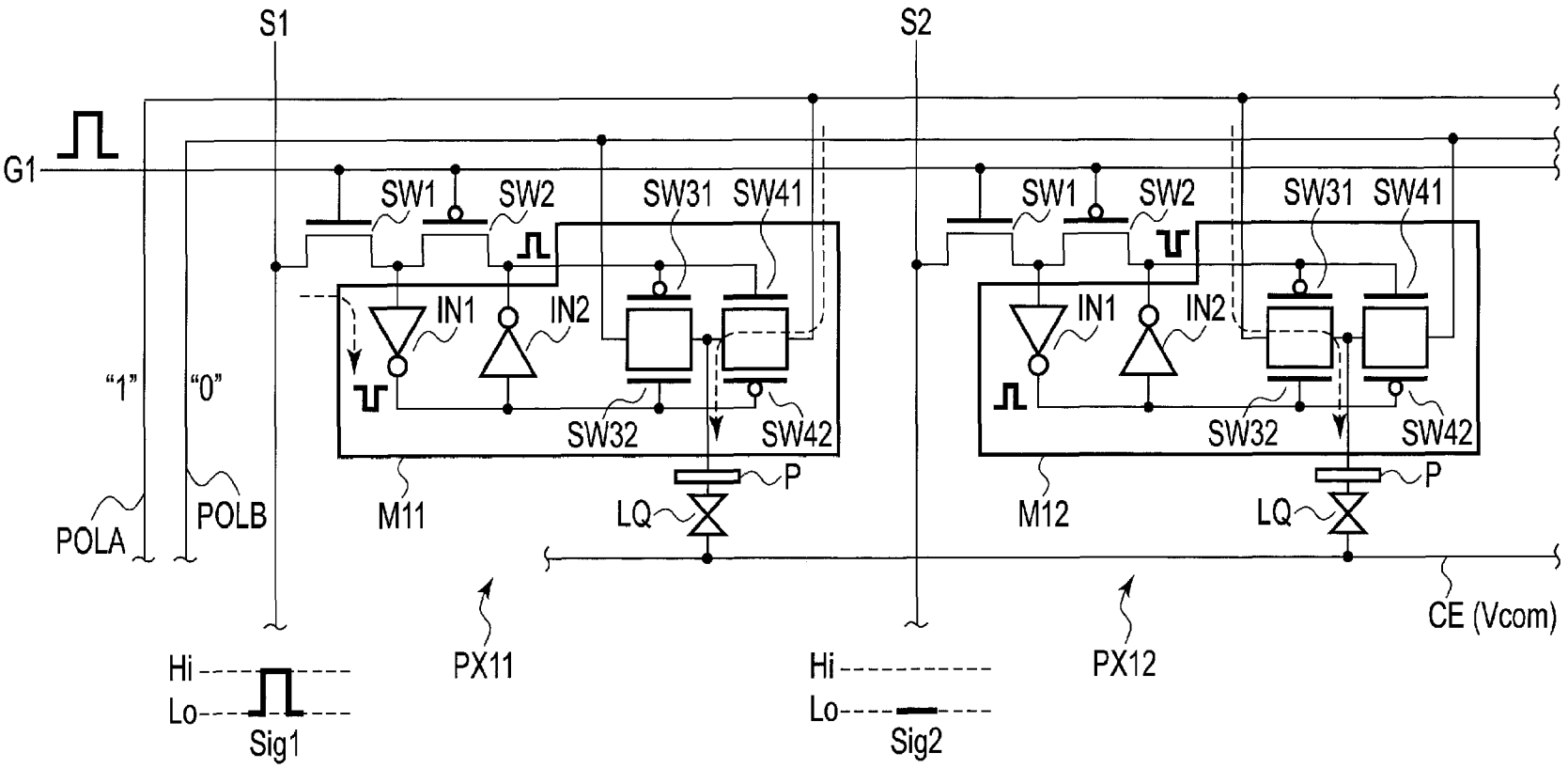
FIG. 4 is a circuit diagram showing an operation example at the time when high level data is written to the pixels PX11 and PX12 shown in FIG. 2.

FIG. 3 and FIG. 4 are shown to explain an operation example of the pixels PX11 and PX12. FIG. 3 shows potential changes in the first potential line POLA and the second potential line POLB. The potential Vcom of the common electrode CE is a constant potential. The potential of the first potential line POLA is changed within a range from a high level H1 to a low level L1 relative to the constant potential Vcom. In contrast, the potential of the second potential line POLB is changed within a range from a high level H2 to a low level L2 relative to the constant potential Vcom. In this case, the amplitude of the potential of the second potential line POLS is less than the amplitude of the potential of the first potential line POLA. The potential change directions of the first potential line POLA and the second potential line POLB are changed in synchronization with the opposite polarity directions. The high level H2 is equal to a high potential power supply level of the inverters in the memory circuit M11 or M12, and the low level L2 is equal to a low potential power supply level of the inverters in the memory circuit M11 or M12.

As shown FIG. 4, it is assumed that a high level gate pulse is supplied to the gate line G1 and a memory rewrite period begins. It is also assumed that a high level signal is input to the source line S1 and a low level signal is input to the source line S2. At this time, in the pixel PX11, the switch SW1 is turned on and the switch SW2 is turned off. Accordingly, the output of the inverter IN1 is at low level and the output of the inverter IN2 is at high level. As a result, the switches SW31 and SW32 are turned off, the switches SW41 and SW42 are turned on, the voltage of the first potential line POLA is stored as one-bit data, and the data is supplied from the common electrode (output side common electrode) of the switches SW41 and SW42 to the pixel electrode P. That is data "1" is stored in the memory M11.

In contrast, in the pixel PX12, the switch SW1 is turned on and the switch SW2 is turned off in response to the gate pulse. Since the low level signal is input to the source line S2, however, the output of the switch SW1 is at low level. Accordingly, the output of the inverter IN1 is at high level and the output of the inverter IN2 is at low level. As a result, the switches SW31 and SW32 are turned on, the switches SW41 and SW42 are turned off, the voltage of the first potential line POLA is stored as one-bit data, and the data is supplied from the common electrode (output side electrode) of the switches SW31 and SW32 to the pixel electrode P. That is data "1" is stored in the memory M12.

According to the above circuits, the high level signal should be supplied to the source line of the pixel PX11 and the low level signal should be supplied to the source line of the pixel PX12 in order to store the same one-bit logical data in the memory circuit of the pixel PX11 and the memory circuit of the pixel PX12. Therefore, for example, if white data is written to the pixel PX11 and the pixel PX12, the high level signal is supplied to the source line S1 of the pixel PX11 and the low level signal is supplied to the source line S2 of the pixel PX12 in the present embodiment. As described above, the first memory circuit M11 of the first pixel PX11 and the second memory circuit M12 of the second pixel PX12 adjacent to the first pixel PX11 can store data of the same polarity when each first switch SW1 is turned on and input signals of different potentials are supplied to the source lines S1 and S2. This is because the first memory circuit M11 and the second memory circuit M12 are different from each other in a connection pattern to the first potential line POLA and the second potential line POLB.

In FIG. 3, the amplitude of the potential of the first potential line POLA is greater than that of the second potential line POLB. However, vice versa, the amplitude of the potential of the first potential line POLA may be less than that of the second potential line POLB. The changing potentials are of opposite polarity. The frequency of changes corresponds to a speed of switching the pixel electrode between positive and negative and is set to improve efficiency of liquid crystal drive.

Figure 5:
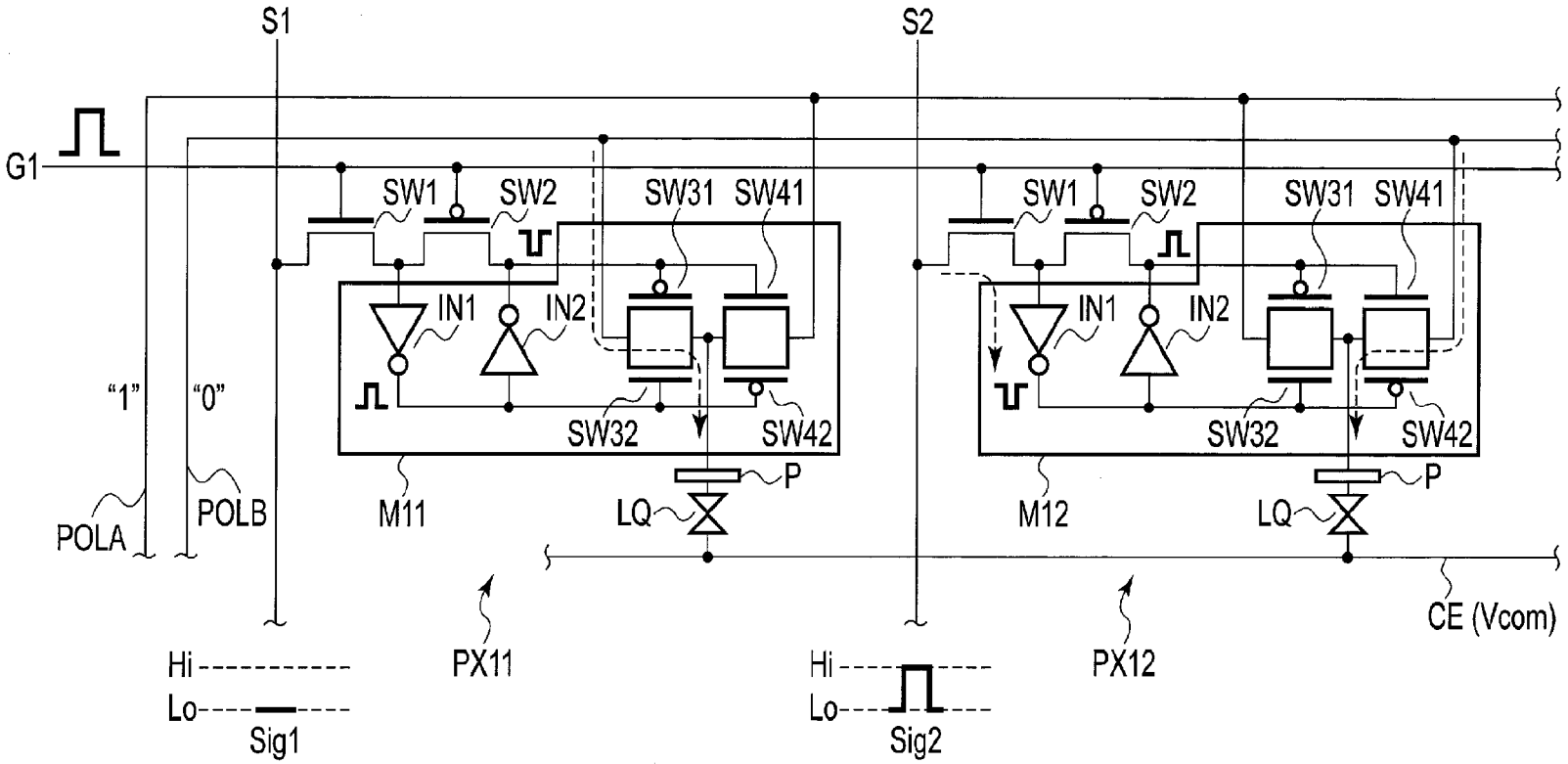
FIG. 5 is a circuit diagram showing an operation example at the time when low level data is written to the pixels PX11 and PX12 shown in FIG. 2.

FIG. 5 is shown to explain operation at the time when data 1 is rewritten as data 0 after data 1 is written to the first memory circuit M11 and the second memory circuit M12 as shown in FIG. 4. It is assumed that a high level pulse is supplied to the gate line G1 and a memory rewrite period begins. In this case, the low level signal is input to the source line S1 and the high level signal is input to the source line S2.

At this time, the switch SW1 is turned on and the switch SW2 is turned off. Since the source line S1 is at low level, however, the output of the switch SW1 is also at low level in the pixel PX 11. Accordingly, the output of the inverter IN1 is at high level (inverted output) and the output of the inverter IN2 is at low level. As a result, the switches SW31 and SW32 are turned on, the switches SW41 and SW42 are turned off, the voltage of the second potential line POLB is stored as data 0, and the data is supplied from the common electrode (output side electrode) of the switches SW31 and SW32 to the pixel electrode P. That is data "0" is stored in the memory M11.

In contrast, in the pixel PX12, the switch SW1 is turned on and the switch SW2 is turned off by the gate pulse. Since the high level signal is input to the source line S2, the output of the switch SW1 is at high level. Accordingly, the output of the inverter IN1 is at low level (inverted output) and the output of the inverter IN2 is at high level. As a result, the switches SW31 and SW32 are turned off, the switches SW41 and SW42 are turned on, the voltage of the second potential line POLB is stored as data 0, and the data is supplied from the common output electrode of the switches SW41 and SW42 to the pixel electrode P. That is data "0" is stored in the memory M12.

FIG. 2, FIG. 4 and FIG. 5 have shown the configurations of the pixels PX11 and PX12 as a representative. In the present embodiment, the same connection pattern as the connection pattern of the pair of pixels PX11 and PX12 to the first potential line POLA and the second potential line POLB is repeated with respect to other pairs of pixels PX13 and PX14, pixels PX15 and PX16, pixels PX17 and PX18, . . . . The same connection patterns are provided in other rows.

That is, the present embodiment is basically a display device comprising: parallel gate lines; parallel source lines crossing the gate lines; a first potential line and a second potential line parallel to each of the gate lines; and pixels arranged near intersections of the gate lines and the source lines, respectively.

Each of the pixels comprises: a first switch, a corresponding source line being connected to an input electrode of the first switch, the first switch being turned on when a corresponding gate line is at one potential and turned off when the gate line is at the other potential; a second switch, an input electrode of the second switch being connected to an output electrode of the first switch in series, the second switch being turned off when the corresponding gate line is at the one potential and turned on when the gate line is at the other potential; and a memory circuit which stores any one of a first potential of the first potential line and a second potential of the second potential line as data when the first switch is turned on and an input signal of a predetermined potential is input from the corresponding source line. The first memory circuit of the first pixel is different from the second memory circuit of the second pixel adjacent to the first pixel in a connection pattern to the first potential line and the second potential line such that the circuits store data of the same polarity when the first switch of each circuit is turned on and input signals of different potentials are supplied to the source lines.

A driving method is a method of supplying write signals of different polarities (potentials) to source lines of adjacent pixels when the same signal (data) is written to memory circuits of the pixels. According to the above device, pixels connected to the same source line are the same in logic. Therefore, it is rare that memory circuits in which data is rewritten at the same time are concurrently switched from high level to low level or from low level to high level. A substantive operation margin can be thereby increased. In other words, operation of an output circuit of pixel signal is stable with respect to various types of input data. If raster display is frequently executed, potentials of adjacent source lines are different from each other in polarity. Therefore, a number of source lines are prevented from being charged or discharged concurrently. As a result, a data error is prevented from occurring in the output circuit of pixel signal and the operation of the device is stable. In addition, the power consumption of the device can be reduced.

Liquid crystal molecules in the liquid crystal layer are driven by an electric field which occurs between the common electrode CE and the pixel electrodes P. The liquid crystal layer LQ between the first substrate SUB1 and the second substrate SUB2 is driven by an electric field which occurs between the pixel electrodes of the first substrate SUB1 and the common electrode formed on the second substrate SUB2. If the display device is a reflective display device, a light reflective material such as aluminum is used for the pixel electrodes P. Whether light is reflected from the pixel electrodes P depends on the alignment state of the liquid crystal molecules between the pixel electrodes P and the common electrode.

However, the driving method is not limited to the above method. The pixel electrodes and the common electrode may be provided on the first substrate SUB1 through an insulating layer and the device may operate in a fringe-field switching (FFS) mode.

Color filters are not described in the present embodiment, but the display device can execute color display. Therefore, an embodiment in which color filters are provided on the second substrate SUB2 is described next.

Figure 6:
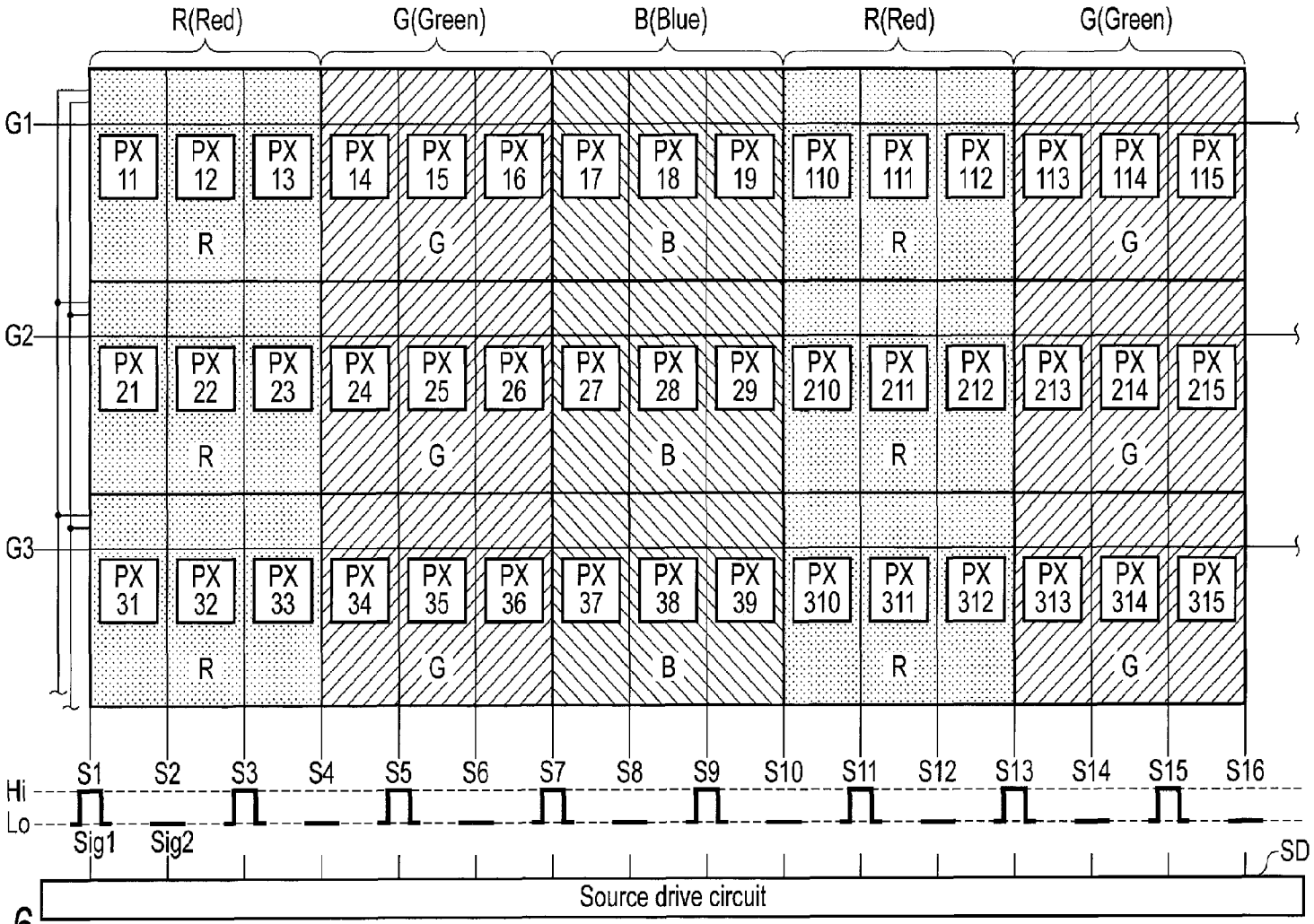
FIG. 6 is a diagram showing another embodiment in which the basic configuration shown in FIG. 1

FIG. 6 shows an embodiment of a display device in which three pixels are defined as a unit (a combined pixel or a tone variable pixel) and a color filter corresponds to each combined pixel or tone variable pixel. In the example illustrated, in the first row, a red (R) filter corresponds to pixels PX11, PX12 and PX13, a green (G) filter corresponds to pixels PX14, PX15 and PX16, and a blue (B) filter corresponds to pixels PX17, PX18 and PX19. An array of the R, G and B filters is repeatedly provided along the row. In the second row, an R filter corresponds to pixels PX21, PX22 and PX23, a G filter corresponds to pixels PX24, PX25 and PX26, and a B filter corresponds to pixels PX27, PX28 and PX29. An array of the R, G and B filters is repeatedly provided along the row.

In the color display device equipped with color filters, too, the connection and the driving method described with reference to FIG. 2 to FIG. 5 are basically applied. The second drive circuit (the source drive circuit) SD outputs a polarity controlled source signal to each source line S (S1, S2, . . . ). The color display device can be configured as a transmissive liquid crystal display device equipped with a backlight or a reflective liquid crystal display device equipped with color filters. In the case of the transmissive liquid crystal display device, the display device comprises a backlight unit outside the first substrate SUB1 and light from the backlight can pass through the first substrate SUB1, the liquid crystal layer and the second substrate SUB2.

Figure 7A:
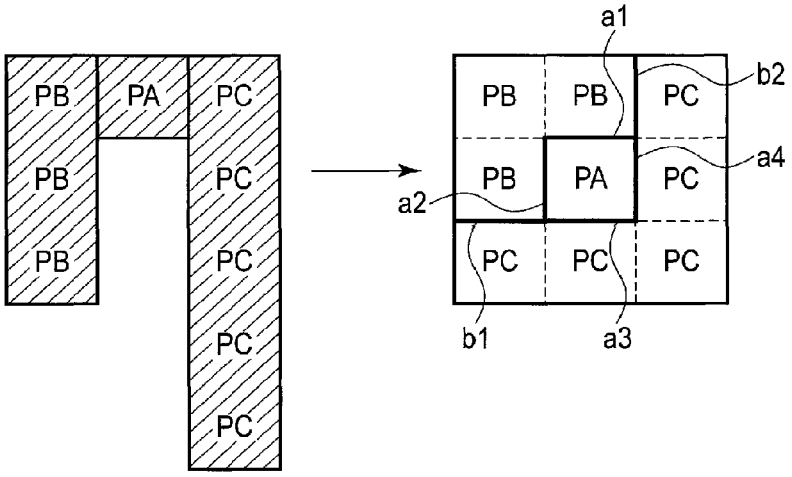
FIG. 7A is an illustration showing a principle of a tone variable pixel of which tone is variable.
Figure 7B:
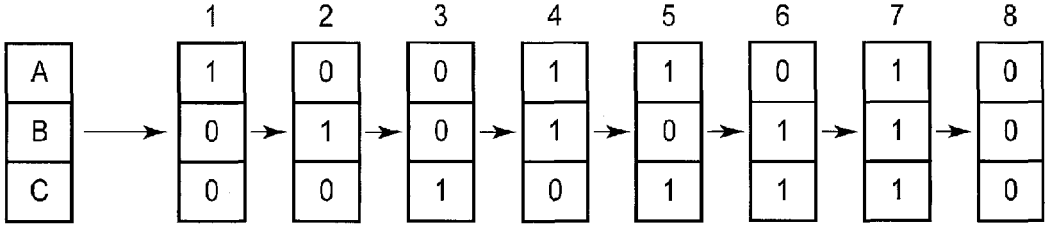
FIG. 7B is an illustration showing a range of tone variation of the tone variable pixel shown in FIG. 7A.

FIG. 7A and FIG. 7B are illustrations showing a principle of tone variation of a combined pixel or a tone variable pixel corresponding to a color filter.

For example, it is assumed that three pixels are a first pixel PA, a second pixel PB and a third pixel PC, the area of a pixel electrode of the second pixel PB is three times the area of a pixel electrode of the first pixel PA, and the area of a pixel electrode of the third pixel PC is five times the area of the pixel electrode of the first pixel PA. It is also assumed that the pixel electrode of the first pixel PA has a square shape, the pixel electrode of each of the second pixel PB and the third pixel PC has an L-shape and the L-shapes are symmetrical.

As a result, two sides (first and second sides a1 and a2) of the first pixel PA can be surrounded by the second pixel PB. Further, the other two sides (third and fourth sides a3 and a4) of the first pixel PA and two sides b1 and b2 of the second pixel PB can be surrounded by the third pixel PC. According to the tone variable pixel, as shown in FIG. 7B, eight tones can be expressed by combinations of turning on and off of the first pixel PA, the second pixel PB and the third pixel PC. In other words, the amount of light reflected from the pixel electrodes can be controlled in eight tones by the combinations of turning on and off of the pixels (i.e., transparent or opaque state of the liquid crystal layer).

Figure 8:
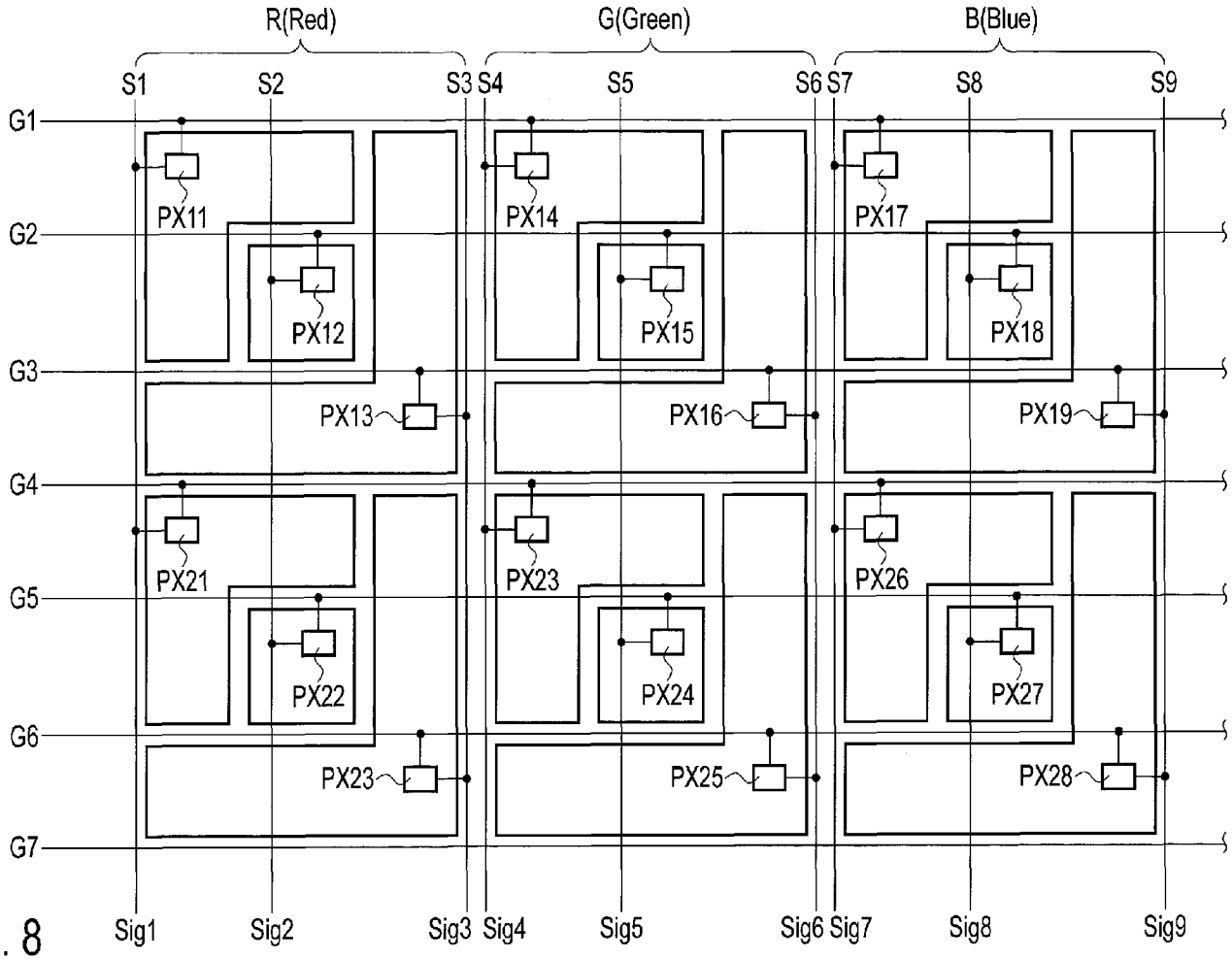
FIG. 8 is a diagram showing yet another embodiment in which tone variable pixels are arrayed in a display area.

FIG. 8 shows a state in which the color tone variable pixels shown in FIG. 7B are two-dimensionally arrayed in the display area.

The gate line G1 is connected to a control electrode of each switch of pixels PX11, PX14, PX17, . . . . The pixels PX11, PX14, PX17, . . . correspond to the second pixel PB shown in FIG. 7A, respectively. The gate line G2 is connected to a control electrode of each switch of pixels PX12, PX15, PX18, . . . . The pixels PX12, PX15, PX18, . . . correspond to the first pixel PA shown in FIG. 7A. The gate line G3 is connected to a control electrode of each switch of pixels PX13, PX16, PX19, . . . . The pixels PX13, PX16, PX19, . . . correspond to the third pixel PC shown in FIG. 7A, respectively.

The pixels PX11, PX12 and PX13 correspond to a red (R) color filter. The pixels PX14, PX15 and PX16 correspond to a green (G) color filter. The pixels PX17, PX18 and PX19 correspond to a blue (B) color filter.

The source line S1 corresponds to the pixel PX11, the source line S2 corresponds to the pixel PX12, the source line S3 corresponds to the pixel PX13, the source line S4 corresponds to the pixel PX14, the source line S5 corresponds to the pixel PX15, the source line S6 corresponds to the pixel PX16, the source line S7 corresponds to the pixel PX17, the source line S8 corresponds to the pixel PX18 and the source line S9 corresponds to the pixel PX19. The source lines and the pixels are connected as shown in FIG. 2, FIG. 4 and FIG. 5.

As described above, an array of R, G and B color tone variable pixels is constructed by the combinations of the gate lines G1, G2 and G3 and pixels PX11, PX12, . . . , PX19, . . . . Only one group of the array of the R, G and B color tone variable pixels is explained on FIG. 8, but similar arrays of R, G and B color tone variable pixels are repeated in the direction of extension of the gate lines.

In the direction of extension of the source lines, rows having the same configuration as the above-described row (i.e., the row of the R, G and B color tone variable pixels) are repeated. Since FIG. 8 is mainly shown to explain a pixel array capable of realizing gradation expression, a circuit configuration of each pixel is schematically shown. The configuration shown in FIG. 2 is basically applied to the circuit configuration of each pixel.

As described above, the present embodiment is a display device comprising: parallel gate lines G; parallel source lines S crossing the gate lines; a first potential line and a second potential line parallel to each of the gate lines G; and pixels PX arranged near intersections of the gate lines and the source lines, respectively.

Each of the pixels PX comprises: a first switch, a corresponding source line being connected to an input electrode of the first switch, the first switch being turned on when a corresponding gate line is at one potential and turned off when the gate line is at the other potential; a second switch, an input electrode of the second switch being connected to an output electrode of the first switch in series, the second switch being turned off when the corresponding gate line is at the one potential and turned on when the gate line is at the other potential; and a memory circuit which stores any one of a first potential of the first potential line and a second potential of the second potential line as data when the first switch is turned on and an input signal of a predetermined potential is input from the corresponding source line. The first memory circuit of the first pixel (for example, PX11 or PX12) is different from the second memory circuit of the second pixel (PX12 or PX13) adjacent to the first pixel (PX11) in a connection pattern to the first potential line and the second potential line such that the circuits store data of the same polarity when the first switch of each circuit is turned on and input signals of different potentials are supplied to the source lines.

Therefore, the first pixel is different from the second pixel in the pixel area (actually, the pixel electrode area). The first, second and third pixels correspond to the same color filter.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

parallel gate lines;

parallel source lines crossing the gate lines;

a first potential line and a second potential line parallel to each of the gate lines for outputting data; and pixels arranged near intersections of the gate lines and the source lines, respectively, wherein each of the pixels comprises:

a first switch, a corresponding source line being connected to an input electrode of the first switch, the first switch being turned on when a corresponding gate line is at one potential and turned off when the gate line is at other potential;

a second switch, an input electrode of the second switch being connected to an output electrode of the first switch in series, the second switch being turned off when the corresponding gate line is at the one potential and turned on when the gate line is at the other potential; and a memory circuit which stores any one of first logical data of the first potential line and second logical data of the second potential line when the first switch is turned on and any one of a high level input signal and a low level input signal is input from the corresponding source line; and a logical data input terminal of a first memory circuit of a first pixel is connected to the first potential line and a logical data input terminal of a second memory circuit of a second pixel adjacent to the first pixel is connected to the second potential line, and the first and second memory circuits have same logic data when input signals of different levels are supplied to source lines corresponding to the first and second pixels while a first switch of each of the first and second pixels is in an on-state, wherein the memory circuit comprises:

a first inverter, the output electrode of the first switch being connected to an input electrode of the first inverter;

a second inverter, an input terminal of the second inverter being connected to an inverted output terminal of the first inverter, an output terminal of the second inverter being connected to an output electrode of the second switch; and third and fourth switches which supply a voltage of any one of the first potential line and the second potential line to a pixel electrode in accordance with different levels of two outputs from the first and second inverters.

2. The display device of claim 1, wherein the first pixel and the second pixel correspond to a color filter of a same color.

3. The display device of claim 1, wherein the first pixel and the second pixel correspond to a color filter of a same color, and a pixel electrode of the first pixel is different in area from a pixel electrode of the second pixel.

4. The display device of claim 1, further comprising a third pixel, wherein a pixel electrode of the first pixel, a pixel electrode of the second pixel and a pixel electrode of the third pixel are different in area from each other.

5. The display device of claim 1, further comprising a third pixel, wherein a pixel electrode of the first pixel, a pixel electrode of the second pixel and a pixel electrode of the third pixel are equal in area to each other.

6. The display device of claim 1, wherein the first switch and the second switch are realized by transistors of different channels.

7. The display device of claim 1, wherein light reflective electrodes are used for pixel electrodes of the pixels.

* * * * *